US008424861B2

(12) United States Patent
Büchel

(10) Patent No.: US 8,424,861 B2
(45) Date of Patent: Apr. 23, 2013

(54) APPARATUS AND METHOD FOR THE PRODUCTION OF MULTI-PIECE PRINTED PRODUCTS

(75) Inventor: Karl Büchel, Hinwil (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 12/734,214

(22) PCT Filed: Oct. 10, 2008

(86) PCT No.: PCT/CH2008/000427

§ 371 (c)(1),
(2), (4) Date: Apr. 19, 2010

(87) PCT Pub. No.: WO2009/049438

PCT Pub. Date: Apr. 23, 2009

(65) Prior Publication Data

US 2010/0237553 A1 Sep. 23, 2010

(30) Foreign Application Priority Data

Oct. 18, 2007 (CH) ..... 1633/07

(51) Int. Cl.
*B65H 39/065* (2006.01)

(52) U.S. Cl.
USPC ..... 270/52.3; 270/52.14; 270/52.16; 270/52.26; 270/52.29

(58) Field of Classification Search ..... 270/52.3, 270/52.14, 52.16, 52.18, 52.26, 52.29; 271/184, 271/185, 187, 82, 85, 204
See application file for complete search history.

(56) References Cited

U.S. PATENT DOCUMENTS

| | | | | |
|---|---|---|---|---|
| 3,951,399 | A | 4/1976 | Reist | |
| 4,981,291 | A | 1/1991 | Honegger et al. | |
| 5,052,666 | A | 10/1991 | Hänsch | |
| 5,052,667 | A | 10/1991 | Shibata | |
| 5,098,076 | A | 3/1992 | Kelsey | |
| 5,324,014 | A | 6/1994 | Honegger et al. | |
| 5,326,209 | A | 7/1994 | Duke | |
| 5,562,278 | A * | 10/1996 | Muller et al. | 270/58.21 |
| 5,657,978 | A * | 8/1997 | Meier et al. | 270/52.16 |
| 7,581,724 | B2 * | 9/2009 | Stauber | 270/52.3 |

FOREIGN PATENT DOCUMENTS

| | | |
|---|---|---|
| CH | 575 303 A | 5/1976 |
| CH | 584 153 | 12/1976 |
| DE | 2 447 336 | 4/1975 |
| EP | 0 095 603 A | 12/1983 |
| EP | 0 218 872 A | 4/1987 |

(Continued)

*Primary Examiner* — Leslie A Nicholson, III
(74) *Attorney, Agent, or Firm* — Pauley Petersen & Erickson

(57) ABSTRACT

An apparatus and method for collating printed products. The apparatus includes a collating drum rotatably driven about a horizontal axis of rotation and at least functionally subdivided into axial sections, provided with separate compartments or saddle-shaped supports that are externally open in a radial direction. A first feeding device delivers printed products to the processing drum, and a conveyor conveys the printed products away from the processing drum. Conveying elements are associated with the compartments or the supports, and are used for conveying the printed products in the axial direction when the processing drum rotates. A secondary conveying section is arranged between the first feeding device and the conveyor, and a processing station or at least one additional feeding station is located between the first feeding device and the secondary conveying section in order to process the printed products or feed additional printed products.

19 Claims, 5 Drawing Sheets

FOREIGN PATENT DOCUMENTS

| | | | |
|---|---|---|---|
| EP | 0 341 424 | A | 11/1989 |
| EP | 0 341 425 | A | 11/1989 |
| EP | 0341 423 | A | 11/1989 |
| EP | 0 409 770 | B | 1/1991 |
| EP | 0 454 343 | | 10/1991 |
| EP | 0 672 603 | A | 9/1995 |
| EP | 0 681 979 | A | 11/1995 |

* cited by examiner

APPARATUS AND METHOD FOR THE PRODUCTION OF MULTI-PIECE PRINTED PRODUCTS

BACKGROUND OF THE INVENTION

1. Field of the Invention

The present invention resides in the field of the collection and working of multipart printed products and relates to a device for the collection of printed products and a method for the production of print articles.

Methods of this type are used to compile any chosen print articles, in particular newspapers and magazines, in a respectively desired manner from different printed products, in particular from main products and part-products or sheets.

In print finishing, the term collect is often used in the wider sense as an umbrella term for collation, insertion and collection in the narrower sense. By collection in the narrower sense is here meant—in contrast to insertion—the sequential placement of part-products, for example of folded sheets, one above the other, in which the part-products are deposited in a predefined sequence one after the other on saddle-shaped rests. In this collection in the narrower sense, collection is carried out from inside to out, since the part-product which is situated on the inside in the finished print article is deposited on the rests as the first part-product. In contrast thereto, by insertion is meant the collection from outside to in. A wide variety of methods for the production of multipart printed products by means of collection or insertion are known to the person skilled in the art.

For the production of such printed products using high-performance methods, collection and insertion drums made by Ferag AG have been proved successful in the market for years. With these drums, in respect of collection saddle-shaped supports, in respect of insertion V-shaped compartments, are led continuously past a plurality of feed-in or supply points, and at each supply point a further part-product or the main product, for instance a further folded sheet, is usually added to the formed product by means of feeding devices. In the case of collection in the narrower sense, a start is usually made with an innermost folded sheet, in the case of insertion with an outermost folded sheet or main product.

With the known high-performance devices, outputs of 40,000 to over about 80,000 print articles per hour are producible. The path of conveyance of the printed products between the successive feeding devices, which are often referred to as feeders, or other working stations runs in the drum-shaped apparatuses of the latest product generations in an irregular spiral shape, regions without axial advance respectively alternating with regions with axial advance. In the case of collecting apparatuses in the narrower sense, such as the gathering-stitching drums of Ferag AG, as are known, for example, from U.S. Pat. No. 5,324,014, the printed products to be produced are deposited on saddle-shaped supports. The sequence in which the individual part-products, and the main product, are brought together normally corresponds to the sequence in which the successive feeding devices are charged with the products. Within an apparatus or drum, this sequence, in known methods and apparatuses, cannot be changed within a run.

The facility to prepare, for example glue or stitch, part-products in early process stages outside the collecting apparatus is known, but is currently still utilized in relatively small measure. Some reasons for the reluctance of professionals to collate already previously worked part-products are listed in EP-B-0409770. If pre-produced part-products, or part-products obtained simultaneously on different process sections, are intended to be connected to form an end product, then the ready-collected end product is usually first glued in the collecting apparatus or a downstream working apparatus.

A print article, comprising, for example, a news magazine collected and stitched in a gathering-stitching drum, with an inner folder, can at present only be produced by the insertion of the folder into the news magazine after the latter has been stitched, the stitching of the folder following the collection, and the subsequent insertion of the folded product in a further working step.

2. Discussion of Related Art

For the person skilled in the art, the terms main product and part-product, in connection with the aforementioned types of collection in the narrower sense and of insertion, are clearly defined, and he will be familiar from the prior art with the respective relative position of the products one to another, their orientation in the production process and the time sequence of their supply.

CH 584153 and the corresponding U.S. Pat. No. 3,951,399 disclose an insertion drum in which, at a first supply point, a first folded printed product, for example a main product, is introduced, with its fold forward, into a pocket-like receiving part of a star feeder and, in the course of one revolution of the star feeder, the print product is opened and conveyed to the next, axially offset supply point. At this next supply point, a further, folded print product is inserted into the first, opened print product. It is described that, at further downstream supply points, further print products are inserted into the opened print product, whereupon, respectively, the already inserted print product is opened to allow the insertion of the directly following print product. The multipart end products or articles which are thereby formed thus have an outer part, which is fed first into the insertion drum, and at least one inner part disposed therein. In this collection from outside to in, the order or sequence of products in the finished article is defined, as already mentioned, by the order, or the charging, of the feeding devices. Thus, for example, a part-product inserted by a third feeding device in the sequence cannot end up as a main product beneath the part-products inserted by a first and second feeding device. The flexibility of the apparatus in the production of the print articles is correspondingly limited.

EP 454343 discloses a method and an apparatus with which also other types of multipart print articles than those previously known can be produced and known print articles can be joined together differently. Here, at least one inner part and an outer part are joined together into an end product not solely by collection in the narrower sense, the folded outer part finally being placed with its open side margin opposite to the fold to the fore astride the inner part. The fact that the outer part is added on only at the end allows inner parts to be joined together in any chosen manner. Thus the possibility exists, for instance, for the inner parts to be collected in the narrower sense or to be inserted one into the other. It is also possible, however, for a further inner part to be deposited astride an inner part or a plurality of joined-together inner parts, and, if need be, for at least one further inner part to be added laterally thereto. At the end, the outer part is then placed astride all joined-together inner parts. The method thus allows print articles to be produced in which, respectively, that open side margin of an inner part which lies opposite the fold runs along the fold of the outer part. It has been shown in practice that the transport of the plurality of differently orientated inner parts or part-products in the axial direction along the translatory conveying section, which in the drum, moreover, is superimposed by the rotary component, is not without problems. Although the method and the apparatus according to EP 454343 already offer a high measure of flexibility in the compilation of the end products, a product in which that sequence of part-products which exists in the end product differs from the sequence of feeding devices in the direction of conveyance along the conveying section is here too, however, unachievable.

For an understanding of the present invention, it is important briefly to consider the commonalities and differences of the rotary collecting apparatuses, i.e. of the collecting drums in the narrower sense and insertion drums, and the limitations which exist in the known rotary methods. The prior art of the rotary collecting principles is set out with reference to a few embodiments which are described below.

CH 584153 shows a "traditional insertion drum" for the insertion of printed products, which revolves about a single axis. The central element of the insertion drum is the horizontal-axis elongated star feeder with axially successive portions. The star feeder is characterized in that the inserted printed sheets describe not only a two-dimensional path, but a helical or spiral path, i.e. a three-dimensional curve. By means of advancing means, for example roller tracks which are configured in connection with pressure elements, the printed sheets are displaced along the axis from portion to portion and so complete, though as yet unstitched printed products are formed, which at the end of the drum are removed at a removal point.

In DE 2447336, an insertion and collecting drum is described, which can be used, in particular, to insert at least one primary product into a folded main product. It is already provided, however, that the collection in the narrower sense too can be carried out from inside to out, in which case, at one end of the star feeder, the innermost section and, following thereupon, one after the other, the more and more outer lying section, have to be supplied. It is disclosed that the folded sheets can be collected from inside to out on rests and are conveyed on a helical or spiral line about the center axis, the folded sheets being displaced from loading point to loading point by means of advancing means. Furthermore, the person skilled in the art infers from the document that the printed sheets are fed to the rests, preferably continuously, by means of so-called clamping conveyors. A high processing speed is achieved by a continuous delivery of the folded sheets from the clamping conveyors and by a displacement of the folded sheets from compartment to compartment of the star feeder. The person skilled in the art also includes revolving collectors, as are known, for example, from EP 0095603, under rotary collecting technique. A gatherer-stitcher revolving about two axes here forms, instead of a drum, the central element of the apparatus. As in the case of the collecting drums, feed stations or other feed conveyors can be used to charge the revolving receiving saddles. In EP 0095603, feed conveyors having grippers are described, which are fastened to a revolving traction member at a distance apart and the delivery regions of which run substantially in the same direction as the direction of conveyance of the collecting conveyor. A continuous combing-in of the printed sheets is effected over a lengthy path of conveyance, so that difficulties of charging by means of feed stations are able to be prevented.

Common to the known rotary working devices and methods is that the main products and/or part-products to be conveyed are orientated in the drum, with respect to the radial component of the direction of conveyance, with a supporting edge orientated transversely to the path of conveyance and, with respect to the axial or translatory component of the direction of conveyance, along or parallel to the direction of conveyance.

Further devices which have a processing drum and are used for processing print products are known, for example, from EP-A 0341425, EP-A 0341424 and EP-A 0341423, as well as the corresponding US patent specifications U.S. Pat. Nos. 5,052,667, 5,052,666 and 4,981,291. By means of these devices, folded print products are collected by being deposited one on top of the other astride the wall elements of the processing drum, and the collected print products, if need be, are provided with a stapling, or the print products in the compartments of the processing drum are collated or inserted by being placed side by side or by print products being introduced into other folded print products.

In EP 0681979, it has already been described that certain working operations on print products cannot be carried out in processing drums, or, at least, only with great effort. In addition, there are working operations which demand a considerable amount of time or consist of a number of successive work steps. This necessitates, if the processing capacity is to remain constant, large structural lengths of the processing drum, which, in addition to the increased spatial requirement, can also lead to design problems.

In EP 0681979, the execution of certain working steps on the print products, or the adding of additional articles to the printed products, is already therefore proposed no longer in the processing drum, but rather in a circulation loop. In the transfer from the processing drum to the circulation loop and from the circulation loop back to the processing drum, the print products maintain their state without change. Since the circulation loop can be run along practically any chosen motional path, the opportunity is given for very varied working steps in the region of the circulation loop outside the actual processing drum. The circulation loop offers, in particular, the facility to lead the printed products away from the processing drum for the performance of specific working steps, or for the feeding of additional products, and to return them to the processing drum for finishing. It is further proposed that, by means of a circulation loop, the previously collected printed products are able to be transferred from one processing drum to the other. It is described as a fundamental advantage of EP 0681979 that the print products maintain their state when transferred from the circulation loop to the processing drum, or vice versa. It is clear that the device according to EP 0681979 is suitable for processing both print products which are arranged astride the wall elements of the processing drum and the dividing elements of the circulation loop and/or print products which are introduced between the dividing elements into the receiving parts of the circulation loop. Within those elements of a circulation loop which are disposed outside the processing drum, the printed products are not conveyed in the axial direction.

In a preferred embodiment according to FIG. 8, in EP-A 681979 it is further proposed that, through the sequential arrangement of two circulation loops, the printed products to be produced are moved away from the drum by means of a first circulation loop and are fed back to the drum by means of a second circulation loop arranged downstream in the axial direction.

In FIG. 9, an embodiment is shown in which, in a processing device, three processing drums are connected to one another by two loops. The transfer of the print products from one processing drum to the next, or the leading away of the print products from a processing drum, is respectively realized by means of circulation loops.

The arrangements proposed in EP 0681979 already allow a high measure of flexibility in the production of print articles from a plurality of printed products. The order of the printed products in the finished print article is also additionally determined by the sequence of the feeding devices along the conveying section.

In none of the known high-performance collecting apparatuses in the wider sense is it possible to break, change or reverse the collecting direction, i.e. the fixedly predefined direction of the sequential arrangement of the products in the finished article, in just one apparatus. For instance, in no known gathering-stitching drum is it possible to collect a magazine (in the narrower sense), stitch it and then, in the same drum, also insert a folder.

In all known collecting drums in the narrower sense, collection can accordingly be realized in the predefined sequence only from inside to out. In all known insertion drums, insertion can be realized only from outside to in along the path of conveyance.

SUMMARY OF THE INVENTION

The object of the present invention is therefore to provide an apparatus and a method for processing printed products by means of collection, transporting, optional stitching or gluing, and further optional working steps, which eliminate the drawbacks of the known apparatuses and methods and, moreover, allow a substantially higher flexibility in the compilation of the print articles to be produced. This should be made possible without enforced trade-offs in the quality of the production result and without an enforced reduction in the high processing speeds.

A further object of the invention consists in enabling the composition of the print article to be changed with little effort.

This object is achieved according to the present invention by an apparatus having the features of claim 1 and a method having the features of claim 12.

With the method according to the invention, it is possible to produce in one and the same processing drum print articles in which printed products, along the path of conveyance in the drum, are collected (in the wider sense) from outside to in and from inside to out in combination. By virtue of the present invention, the axial sequence of the feeding devices along the drum no longer determines the order of the part-products in the finished article. In insertion drums in which collection is realized in a known manner from outside to in, the present invention allows this sequence to be broken and allows collection to be realized in certain sections from inside to out, which collection from inside to out takes place, so to speak, whilst maintaining the position of the products to be supplied, with the fold directed toward the drum axis.

In collecting drums in the narrower sense, the invention allows the collection from inside to out to be supplemented by one or more collection steps from outside to in. The collection from outside to in is here once again realized without any change in position of the supplied products, with the fold directed away from the drum axis.

With reference to a simple embodiment of a gathering-stitching drum, the inventive basic idea of inverse collection shall be set out in greater detail. In a stitched print article, a folder is to be inserted. To this end, in a gathering-stitching drum, a number of printed sheets are collected in a known manner on a saddle-shaped support during transport past a plurality of feed stations respectively assigned to a drum portion, and, where necessary, are stitched with a stitching apparatus as known, for example, from EP-A 0546326. These stitched products are conveyed out of the drum transversely to the axial direction and are fed to a secondary conveyor, preferably a clamping conveyor having a start-side removal apparatus and an end-side return apparatus. They now pass through a secondary conveying loop and are fed back to the drum in a downstream-situated, for instance a next-but-one portion. In a portion situated between the delivery apparatus and the return apparatus, a further printed product, according to the example a folder, is deposited onto the now unoccupied saddle-shaped support with the aid of a further feeding device. In the following portion, the already stitched magazine is deposited on the folder. If the finished illustrative product is viewed, then it can be seen that, by means of the storage loop and the method according to the invention, a magazine collected from inside to out, with an inversely inserted folder, on a collecting drum has been produced.

In the case of an insertion drum, collection can be realized, as is known, from outside to in, so that along a path of conveyance, for example, a plurality of part-products are collected from outside to in, in a following portion are in turn removed from the drum by means of a storage conveyor, in the storage loop are stitched, and in a next but one portion are led back into the drum. In the intermediate portion, a main product or a cover, for example, is respectively inserted into the now unoccupied V-shaped compartments and conveyed into the following portion of the drum, in which it is opened or held open and stands ready to receive the previously stitched-together part-products. In preferred embodiments, the stitched-together part-products can be glued into the cover. To this end, a sufficient quantity of adhesive is introduced into the inner fold of the cover at the bottom of the V-shaped compartment, prior to the insertion of the stitched part-products. According to preferred embodiments, the gluing points can also be applied on the part-product. The end article is a magazine having an inner part made up of part-products which are collected from outside to in in a known manner, and in which the cover and stitched part-products are collected inversely from inside to out. Particularly in the case of thin cover sheets, with the above-described method according to the present invention it is possible to prevent the thin sheet from having to be conveyed through the whole of the drum. The risk of it being crumpled or buckled can thus be heavily reduced.

In contrast to previously known methods, in which the main products, part-products and primary products were able to be collected in a collecting drum only in one or other of the collecting direction from inside to out and from outside to in, by means of the apparatuses and methods according to the present invention both collecting directions can be combined without the need to reverse the orientation of the products in relation to the drum axis.

Contrary to the previously known teaching, it is now possible in a single collecting drum to no longer collect only in the sequence P1->P2->P3 corresponding to the sequence of the products in the active feeding devices, but rather, through the use of a secondary conveying section according to the invention, it is possible to create the product sequence P3->P1->P2 without the need to exchange products in the feed conveyors. The higher is the number of products to be collected, the greater are the variation options.

These part-products are conveyed in the storage loop preferably with known clamping conveyors, even if this means that the products to be conveyed must then be closed. When collection is made in the narrower sense, this means that the products have to be reopened prior to their return into the collecting drum.

The combing-in of the removed part-products back onto the drum rests rotating with the drum can be effected, for example, by means of a method and an apparatus as are disclosed in EP-A 0600216 or EP-A 0647382. The closed, folded printed products are here held in hanging position close to their fold by a clamp of a conveyor and are transported supported in their end region remote from the fold. With the aid of a worm-like piercing element, the printed products are opened, i.e. the two product branches are moved apart and on both sides are released from the clamp over the saddle provided for their reception. The person skilled in the art will be familiar with various other methods in which the products to be supplied can be opened by means of fold grippers or suction grippers.

According to further embodiments, the products conveyed in the secondary conveyor are not closed, but are actively held open by appropriate means. This can be effected, for example, by a trailing branch of a, in the direction of conveyance, first product being respectively held together with a leading branch of a following second product jointly by clamping elements. Such attempts at open product transport are known, for example, from EP-A 1809557.

According to further preferred embodiments, it is ensured that an edge of the outfed products, which edge runs in the direction of conveyance along the shell line, is in the return run once again leading in the direction of conveyance. In these embodiments, the orientation of the products in the feeding devices arranged along the principal path of conveyance, i.e. along the drum, does not have to be changed. Each product maintains its relevant orientation right into the end article, regardless of whether it passes through a secondary path of conveyance or not. The orientation with respect to the direction of conveyance along the shell line plays a crucial role, particularly in the processing of multiseamed folded sheets. If for example, the folded edge running in the direction of conveyance along the shell line is a folded edge which survives in the end article even after the trimming.

In simple embodiments, outfeed could take place in an upper region of the strand and, following hanging passage through a substantially U-shaped secondary conveying section in a downstream drum portion, depositing could take place onto the products which have since been collected and/or, in the case of an inserting apparatus, insertion could take place into these. As a result of the simple U-shaped secondary conveying section, the orientation with respect to the direction of conveyance along the shell line is reversed. That edge of the respective printed product which is leading prior to the outfeed has become the trailing edge following the return run. Through a purposeful use of this effect, originally compiled, multipart print articles can thus be produced in a wide variety of variants in a simple manner.

If no such change in orientation is desired, then the intermediate products previously created in the drum are preferably either removed in the region of the lower strand or are conveyed in a simple spatial curve, with maintained direction of conveyance, along the shell line to the upper strand in a downstream-situated drum portion. In a projection in the direction of the drum axis, in the simplest case only an arc of 180° will pass through. If the products in the upper region of the strand are fed out and, downstream, are led back in the upper region of the strand, then in the simplest case at least one complete circular arc of 360° must be covered in the secondary conveying section. The sense of rotation of the secondary conveying section in relation to the drum axis can here be chosen, in the simpler case, oppositely to the direction of rotation of the drum. If the secondary conveying section is run around the drum, then the sense of rotation of both can be the same.

The type and arrangement of the delivery and return mechanisms, as well as the possibly different conveying apparatuses on the secondary conveying section, can be chosen by the person skilled in the art, according to requirement, from the prior art and can be advantageously combined on the basis of the technical teaching according to the prior art.

The apparatuses and methods according to the present invention are preferably also used in the production of individualized printed products. At minimal additional cost compared with existing systems in terms of process and system engineering, almost any chosen degree of individualization of the multipart print articles to be produced, can be thereby obtained. The degree of individualization of the articles to be produced extends to a magazine or newspaper compiled in a fully addressee-specific manner, in which the order of the individually collected products in the finished article is selected according to a previously known subscriber profile. For a subscriber interested in sport, the sports bundle can be arranged as the main product on the outside, for a less sport-minded reader the sport bundle can be moved inward.

The delivery of the products into the secondary conveying section does not necessarily have to take place in a dedicated drum portion, but can perfectly well, for example, take place in the same drum portion in which, for example, a part-product has previously been supplied. Similarly, the return run can be effected in a drum portion in which, subsequently, yet another product is supplied or a processing step is performed. For the sake of easier comprehensibility, a "dedicated" drum portion shall, however, respectively be assigned below to each feed, delivery and return step.

BRIEF DESCRIPTION OF THE DRAWINGS

The present invention is described in greater detail below with reference to the illustrative embodiments represented in the drawings, wherein, purely schematically.

DETAILED DESCRIPTION OF EMBODIMENTS OF THE INVENTION

Figure 1:
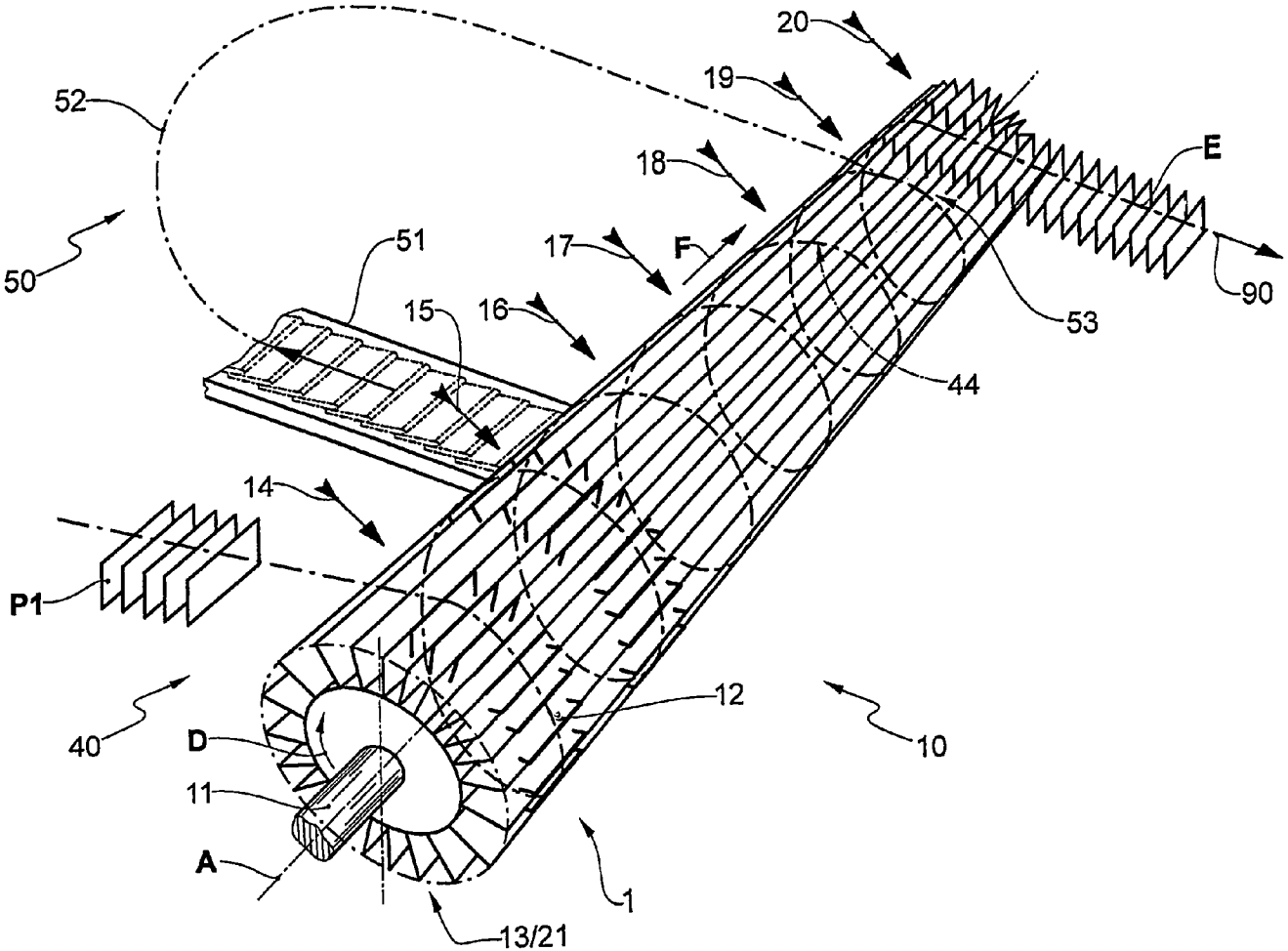
FIG. 1 shows in perspective representation a device according to the invention having a processing drum for processing folded printed products, and a storage section, disposed in the region of the processing drum, for the removal and return run, and possible conductance of processing specific steps on the printed products.

FIG. 1 shows a device 1 for processing print products P1, having a processing drum 10 continuously driven about a horizontal rotation axis A in the direction of rotation D. On a rotary shaft 11 coaxial to the rotation axis A, which rotary shaft is connected in a known manner to a drive motor and is mounted at both ends on a machine stand (not shown), there is disposed a wheel-like or roller-like supporting element, from which radial wall elements 12 protrude in an outward direction and form with their radially outer ends saddle-shaped rests 20 running parallel to the rotation axis A and defining a cylindrical shell surface. The rests 20 are evenly distributed in the peripheral direction of the processing drum 10 and comprise means for displacing the thereon deposited printed products in the axial direction F, i.e. in the direction of the shell line. Since this linear displacement of the products is superimposed by the rotational motion of the drum, the products to be worked are actually conveyed via the indicated spiral or helical spatial curve in the drum. In the case of insertion drums, mutually separated compartments 13 are correspondingly configured between the longitudinally running wall elements 12.

After a first part-product P1 has been placed by a first feeding device 40 (not further represented), for example by a chain conveyor, in a first drum portion 14 onto one of the saddle-shaped rests, the rotation thereof about the cylinder axis A takes place, accompanied by simultaneous continuous displacement, in the direction of the shell line, into a drum portion 15 situated directly downstream in the direction of conveyance. There, after one complete revolution of the drum, a further part-product is deposited onto the first part-product by a feeding device (likewise not further represented), as is known from the collection from inside to out. The two part-products are conveyed one straddling the other into the adjoining third drum portion 16, in which a further product is supplied. The three part-products lying astride one another are conveyed onward along the helical conveying curve into the portion 17 and, on the way there, are stitched together by a stitching apparatus (not shown).

In the drum portion 17, the stitched products, in the region of the lower strand of the drum, are led out of the drum. This is realized, for example, by means of an outfeed conveyor 51, which forms the first portion of a secondary conveying section 50 according to the invention. In the directly following drum portion 18, a fourth part-product is deposited with a further feeding device 44 onto the now unoccupied saddle-shaped rest, which fourth part-product, after the return of the previously stitched product from the secondary conveying section 50, ends up beneath this latter product, i.e. in relation to the article to be produced. The transport of the products from the outfeed conveyor 51 to the return conveyor 53 engaging downstream with the drum is realized, for example, by means of a clamping conveyor 52, so that the products, from the outfeed up to the return feed, have only to be grasped once by a clamp. The return of the stitched part-product into the drum is realized by means of a return conveyor 53 in the portion 19, which substantially corresponds to an apparatus as is known from EP-A 0600612 and has already briefly been described further above. The last portion 20 of the processing drum, at the right-hand end of the drum in the drawing, is an evacuation portion 20, having an evacuation conveyor 90 disposed on the top side of the strand and carrying the print articles E.

Figure 2:
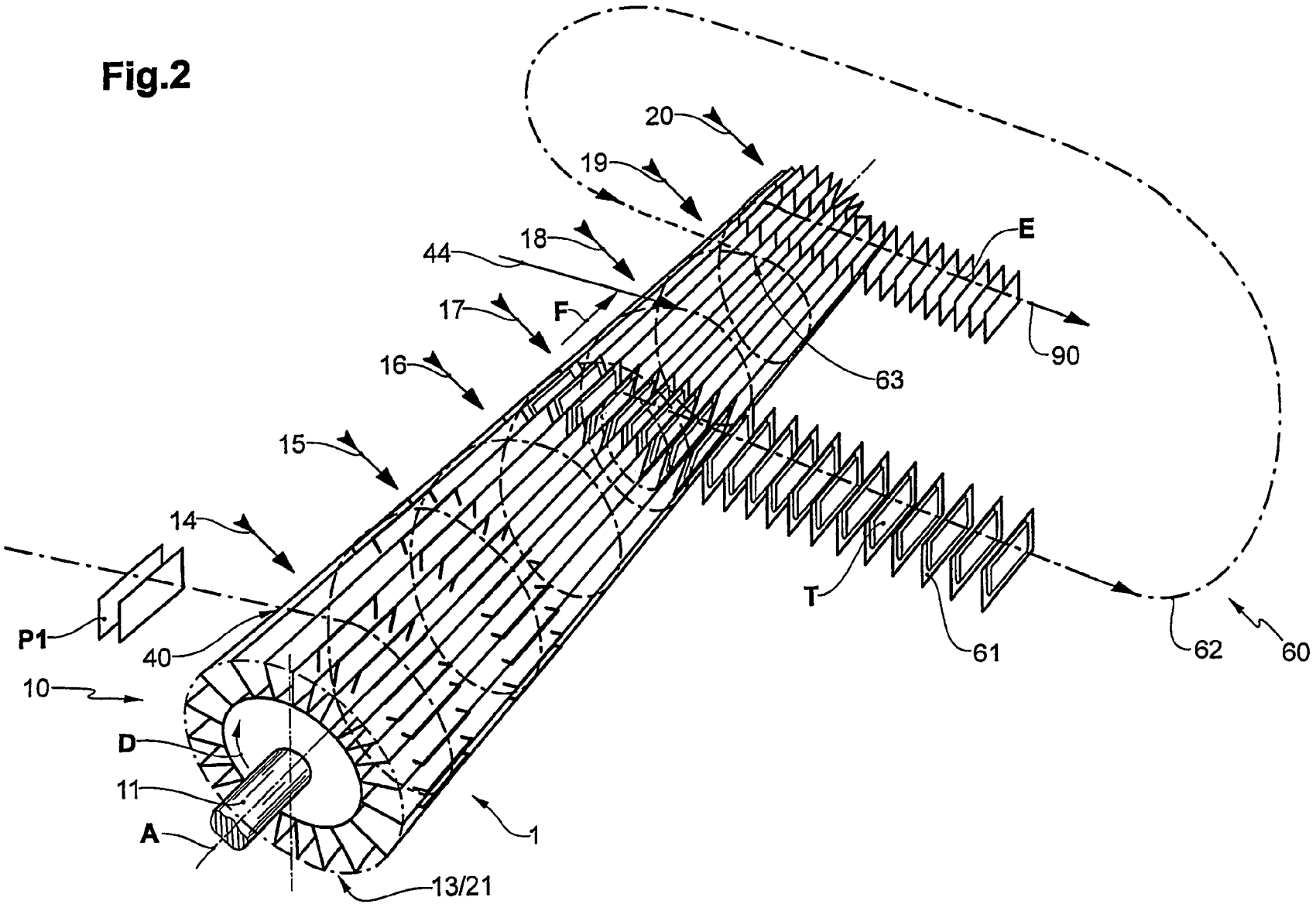
FIG. 2 shows in perspective representation a device according to the invention having a processing drum and a storage section, disposed in the region of the processing drum, according to a further form of the invention.

In FIG. 2, according to a further embodiment of the present invention, in the outfeed portion 17 there is indicated a chain conveyor 61 engaging with the upper strand of the drum, which chain conveyor removes from the drum those products which have previously been collected and stitched in portions 14 to 16 and transports them along a helical spatial curve 62 to the return mechanism in the penultimate drum portion 19. The helical spatial curve 62 ensures that the, in the direction of conveyance, leading edge of the conveyed outward products is once again leading in the direction of conveyance when they are fed back by means of the return conveyor 63.

While in the two illustrative embodiments according to the figures, two very simple variants of the secondary conveying section 50, 60 are indicated, for the person skilled in the art it is easily comprehensible that the present invention allows a virtually optionally long and complex three-dimensional course of the secondary conveying section.

During the conveyance of the products, as already mentioned previously, a wide variety of processing steps, such as, for example, lateral trimming, printing with address codes, sticking-on of labels, etc. can be performed. In further preferred embodiments (likewise not represented in the figures), stitching is carried out not in the drum, but outside the drum in the secondary conveying section.

Figure 4:
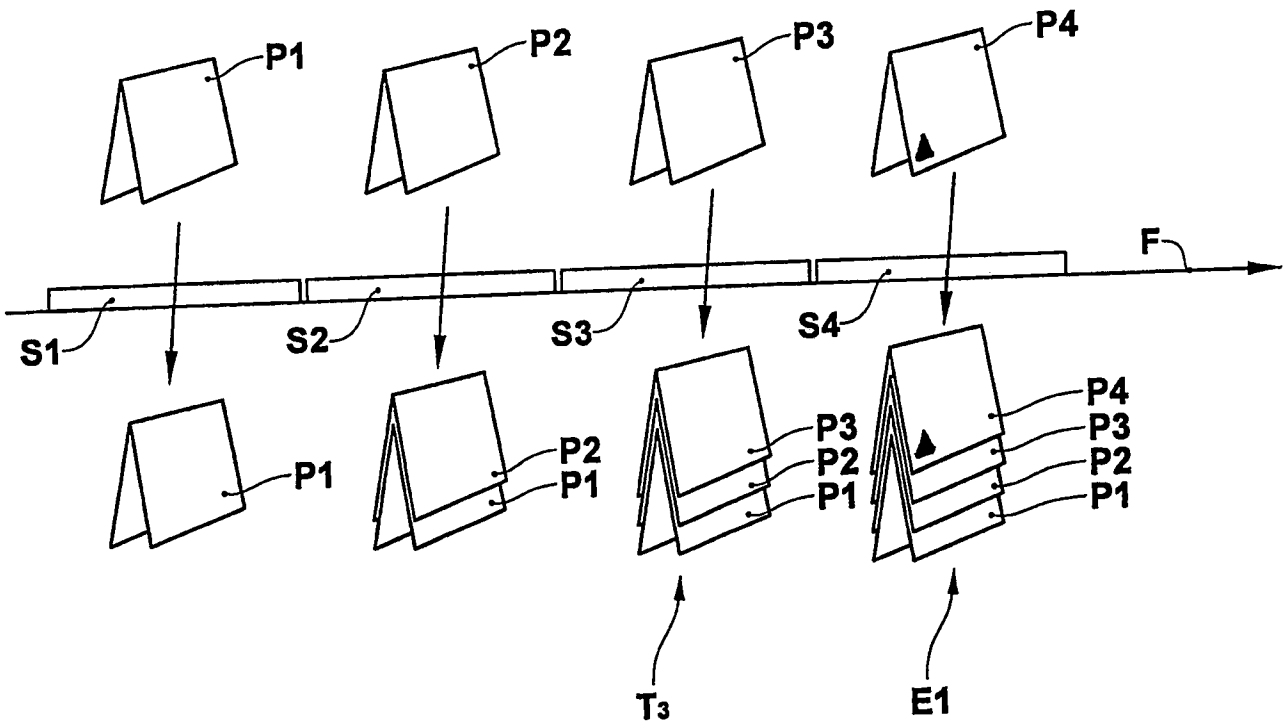
FIG. 4 shows a schematic linear development of a part of the actually spiral processing and conveying path in a collecting drum along a plurality of feed stations according to the prior art, wherein a specific printed product to be supplied is marked with a triangle.
Figure 5:
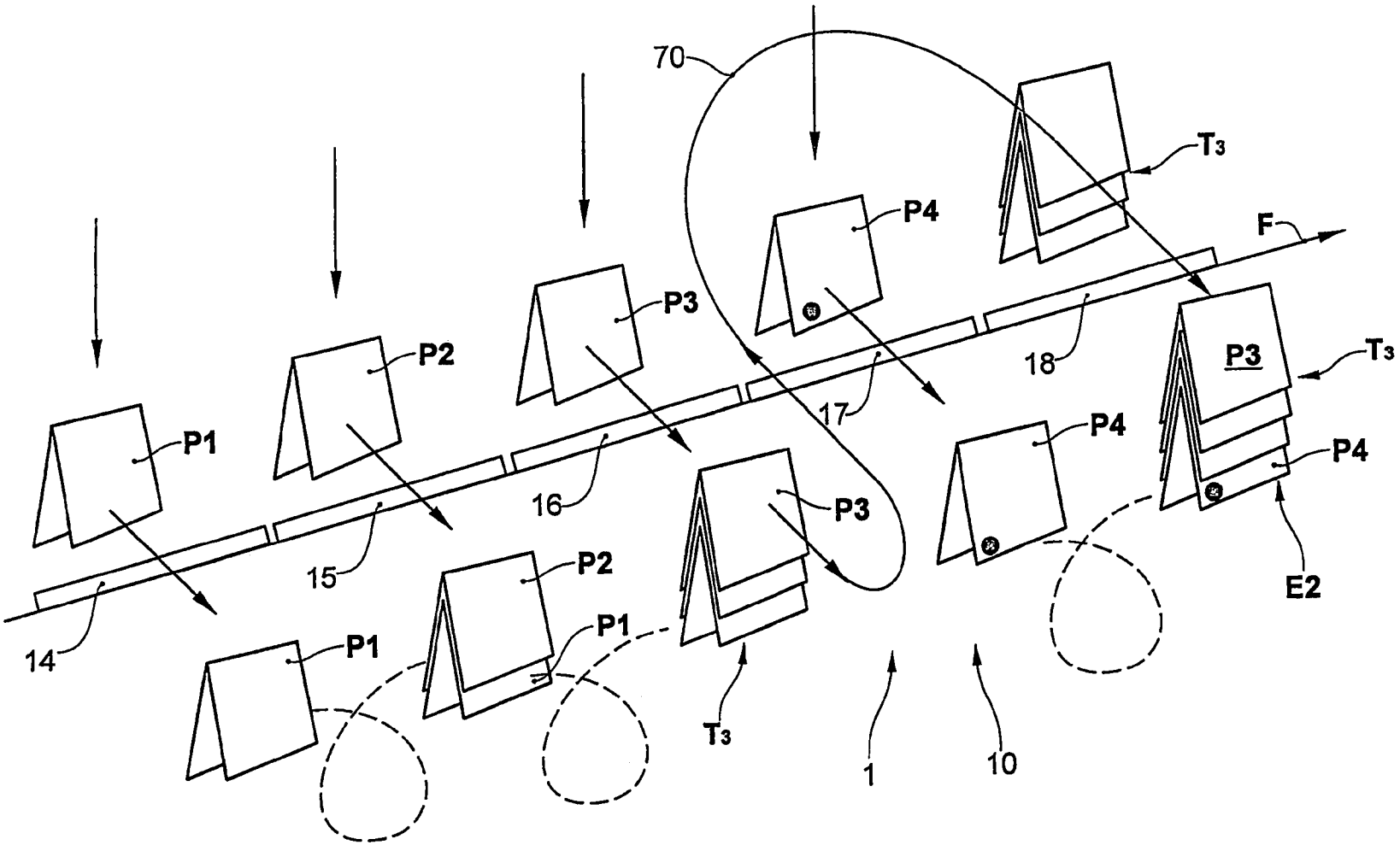
FIG. 5 shows a schematic linear development of a part of the actually spiral processing and conveying path in a collecting drum along a plurality of feed stations, and of the removal and return mechanisms of the storage section according to an embodiment according to the invention, wherein the path of conveyance within the drum is indicated in dashed representation and a specific printed product to be supplied is marked with a circle.

With reference to the simple schematic representations of FIGS. 4 and 5, basic features of an inventive collection in the narrower sense shall be illustrated once again step by step. To the known collecting method according to FIG. 4 is compared in FIG. 5 a new method according to an advantageous embodiment of the invention. In the diagram of FIG. 4 pertaining to the prior art, a traditional collecting operation is represented, in which four printed products P1 to P4 are successively collected from inside to out in four portions of a collecting drum (not represented). For the sake of better clarity, the representation of the correct relative position of the individual products one to another and of their position in the drum is relinquished. In the represented diagram, an attempt has been made to represent the time sequence in the collection in four drum portions or segments S1 to S4 arranged along the axial principal direction of conveyance F, i.e. parallel to the drum axis. Four printed products P1 to P4 to be joined together are respectively disposed in the upper half of the figure and are supplied one after the other in the precisely predefined sequence 1 to 4 by means of a respective feeding device (not represented) of the drum, so that the article to be created is collected step by step over time and over the conveying section from inside to out. Once three products P1 to P3 are already combined into a part-product T3, in the collecting drum of the prior art a further product P4 can be placed only on the outside of the part-product T3, so that the end product E1 is formed, in which the sequence of the products P1 to P4 from inside to out is necessarily P1->P2->P3->P4. Should stitching be intended, the product P1 must necessarily be jointly stitched. At most, the outer products P3 and/or P4 can be put on loose. A stitched product having an inner, loose insert cannot be produced in the apparatus according to FIG. 5.

By contrast, substantially more possibilities are offered by the embodiment of the method according to the invention as represented in FIG. 5. In a collecting drum in the narrower sense, four printed products P1 to P4 are once again processed to form a print article. In order to illustrate the differences against the known method according to FIG. 4, the product P4 is marked with a dot. In the first three drum portions 14, 15 and 16, three products P1, P2 and P3 are once again collected in a known manner from inside to out to form the part-product T3. This part-product T3 can be removed from the drum stitched or unstitched. Essentially, the products which are to be conveyed outward in the apparatuses and methods according to the present invention are preferably removed transversely to the direction of conveyance F. In the region of the outfeed in the segment 16, the part-products are not displaced in the direction F, so that the approximately tangential outfeed from the drum can take place undisturbed by a displacement in the axial direction. The collected part-products T3 here undergo in the delivery no acceleration in a direction other than the tangential evacuation direction. The stitched part-products T3 are conveyed, as described above, along a helical spatial curve from the secondary conveyor 70, past the segment 17, to the segment 18. In the segment 17, onto the now vacated saddles of the collecting drum part-products P4 are fed, onto which, in the following portion 18, the part-products T3 can be deposited. From the outer part-product T3 and the inner product P4, an end product E2 has thus been formed, in which the sequence of the products P1 to P4 from inside to out is P4->P1->P2->P3. Although the product P1—where stitching is intended—must in the present example also necessarily be jointly stitched, in the finished article it no longer has to be situated on the inside. Both the outer products P3 and/or P4 and the innermost product P4 can therefore be provided loose in the article. The method according to the invention allows an article with an inner loose insert, an inversely inserted printed product, to be produced in a collecting apparatus in the narrower sense. If need be, this inversely inserted printed product can also be stitched or glued in place by means of an adhesive point applied to the printed product.

In FIG. 5, the course of the conveying curve of the products P1 to P3 within the collecting drum is indicated in dashed representation. A transport path from the segment 16 into the segment 17 within the drum is not represented, but is of course functionally present in the collecting drum. If so desired, the secondary conveying section can be deactivated at any time and products can be collected in P1->P2->P3->P4 sequence in the previously known manner.

Figure 3:
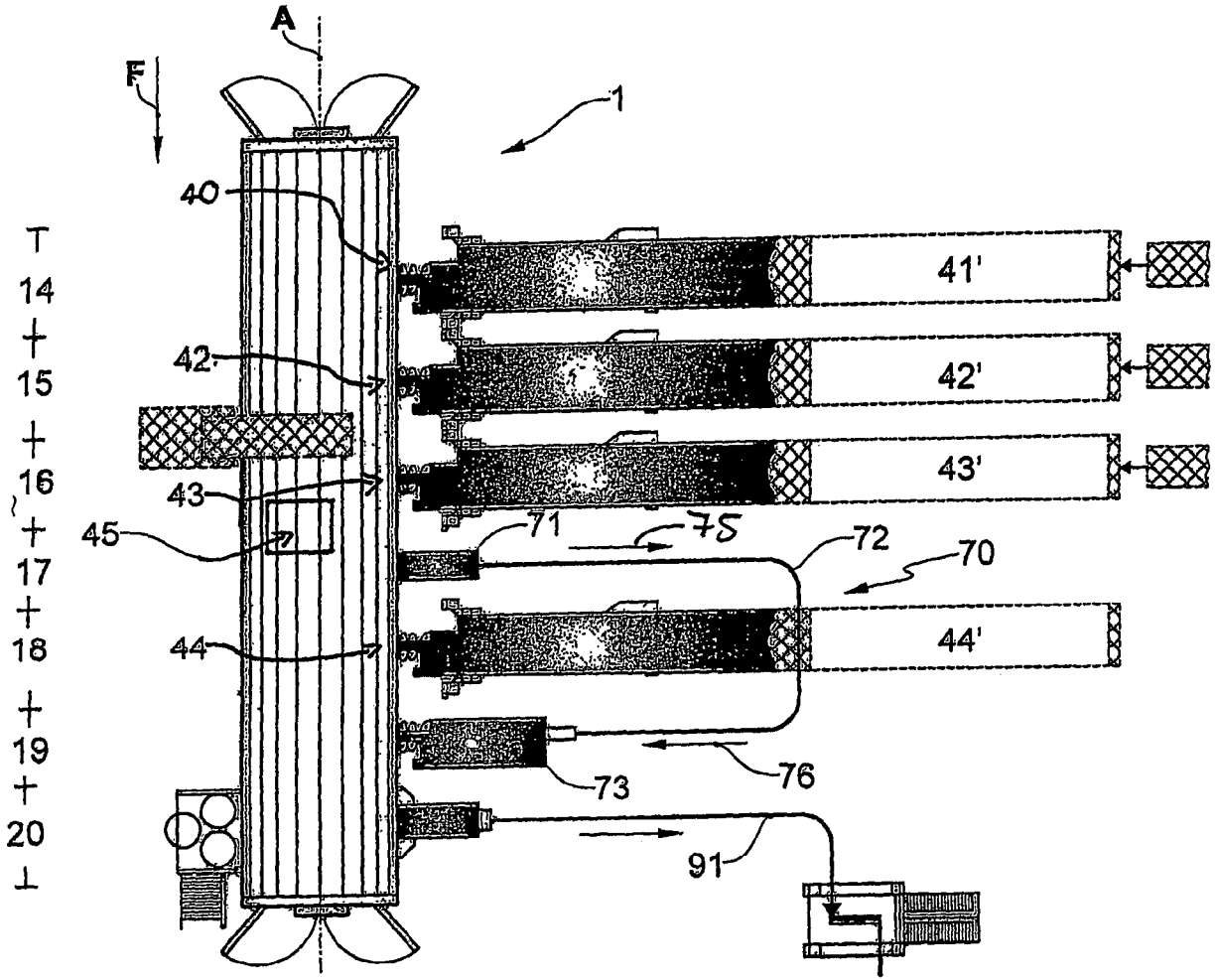
FIG. 3 shows a top view of a gathering-stitching drum according to a preferred embodiment of the present invention.

In FIG. 3, a device for processing printed products according to a further embodiment of the invention is shown in a view from above. The centerpiece of the system is formed by a gathering-stitching drum which is essentially known from the company Ferag AG and which can also be referred to as a folded sheet transport cylinder. On the periphery of the drum are fitted, up to 40 collecting rails, as axis-parallel shell lines. The working units in the form of four feed stations 40, 42, 43 and 44 are located over the drum and are once again part of four bar feeders 41', 42', 43' and 44', as are known from the company Ferag AG. By means of the—in the direction of conveyance—first three feeders, a part-product is produced, as already previously described, which is collected from three products from inside to out and is stitched by a stitching apparatus 45 in the transition region between drum portion 16 and 17.

After the stitching, the part-product in the portion 17 in the region of the lower strand of the drum is delivered onto a belt conveyor 46. The part-product hereupon closes, so that it can be conveyed away from the drum in an orderly imbricated stream. In the represented example, the outfeed conveyor is the belt conveyor 71, which forms the first part of the secondary conveying section 70. From the belt conveyor 71, the products emerging from the drum are transferred, fold forward, to a clamping conveyor 72. In the clamping conveyor 72, each printed product is held by a clamp in the region of the fold and is led back along the secondary conveying section 70 away from the drum, upward in an arc over the bar feeder 44' in the direction of the principal direction of conveyance F and then in an approximately tangential direction 76 to a return region above the drum. By the return mechanism 73, the part-products are opened and deposited astride the printed sheets, which in the portion 18 are deposited by the feeder 44' as new innermost products onto the saddle-shaped rests of the drum. In the segment 20 directly downstream, the now complete articles, in the form of a magazine with loose inner printed sheet, are conveyed away from the drum. For this, an evacuation conveyor 91 is used, which in the represented example is likewise a clamping conveyor. In all embodiments of the drums according to the invention, the segments 14 to 20 of the processing drum preferably have equal lengths, measured in the direction of the drum axis.

If, according to further preferred embodiments, the products to be conveyed outward are taken up in the region of the upper strand of the drum directly by clamping conveyors, then no further transfer of the products within the secondary conveying section is necessary.

The finished article has once again been produced with a combination of traditional collection from inside to out and inverse insertion from inside to out, the feed sequence of the products in the drum not reflecting the successive arrangement of the products in the finished article. Based on the above description and the description of the illustrative embodiments with collecting drums in the narrower sense, the technical teaching according to the invention should reveal itself to any person skilled in the art in such a way that he is capable of transferring this technical teaching to insertion methods and apparatuses.

For collecting drums in the narrower sense, for example for gathering-stitching drums, a wide variety of options for combining the known collecting methods from inside to out and the new inverse insertion method from inside to out are possible. With the insertion methods according to the invention, and the devices with insertion drums, it is possible, on the other hand, to combine the traditional insertion from outside to in with inverse collection in the narrower sense from outside to in. A fundamental advantage of the apparatuses according to the present invention rests on the fact that the combinations of collection and insertion can respectively be realized in the same drum.

Insofar as the drums have a sufficient number of portions, they can be designed in such a way that the traditional collecting and insertion methods can be several times alternately combined with the new inverse methods. The variability in the compilation of the products is in this case subject to only few limits.

The invention claimed is:

1. A device (1) for processing printed products, comprising:

a collecting drum (10) driven rotatingly about an approximately horizontal rotation axis (A) and divided at least functionally into axial portions, the collecting drum including saddle-shaped rests (20), which are open to the outside in the radial direction, are evenly distributed in the peripheral direction and run approximately in the direction of the rotation axis (A), and/or mutually separated compartments (13), a first feeding device (40) for supplying printed products (P) to the processing drum (10), an evacuation conveyor (90, 91), disposed downstream in relation to a first feed (40) in the direction of the rotation axis (A) in the direction of the axial component (F) of the direction of conveyance, for transporting the print articles (E) away from the processing drum (10), conveying elements, assigned to the compartments (13) and/or rests (21), for transporting the printed products in the direction (F) in the course of the revolutions of the processing drum (10), and a working device and/or at least one further feeding device or feed station (41, 42, 43, 44), disposed between the first feeding device (40) and the evacuation conveyor (90, 91), for working the printed products (P, T) and for supplying further printed products (P2, P3, P4), wherein between the first feeding device (40) and the evacuation conveyor (90, 91) there is arranged at least one secondary conveying section (50, 60, 70) for transporting printed products through a secondary path of conveyance.

2. The device (1) of claim 1, wherein the secondary conveying section (50, 60, 70) comprises an outfeed conveyor (51, 61, 71), a secondary conveyor (52, 62, 72), and a return mechanism (53, 63, 73).

3. The device (1) of claim 2, wherein the outfeed conveyor (51, 61, 71) feeds out from the collecting drum (10) the products (T3) to be conveyed outward, the products (T3) are conveyed in the secondary conveyor (52, 62, 72) from the outfeed conveyor (51, 61, 71) to the return mechanism (53, 63, 73), and are led by the return mechanism (53, 63, 73) back into the drum (10), wherein between the outfeed conveyor (51, 61, 71) and the return mechanism (53, 63, 73) there is arranged at least one further feeding unit (44).

4. The device (1) of claim 1, wherein the products (T3) are conveyed out of the drum with a supporting edge orientated transversely to the principal path of conveyance (F).

5. The device (1) of claim 1, wherein the secondary conveying section (50, 60, 70) comprises a clamping conveyor.

6. The device (1) of claim 1, wherein the collecting drum (10) is a collecting drum in the narrower sense, preferably a gathering-stitching drum or an insertion drum.

7. The device (1) of claim 1, wherein along the secondary conveying section there are arranged further devices for the supplying of products and/or for the working of the conveyed products.

8. A device (1) for processing printed products, comprising:

a collecting drum (10) driven rotatingly about an approximately horizontal rotation axis (A) and divided at least functionally axial portions, the collecting drum including saddle-shaped rests (20), which are open to the outside in the radial direction, are evenly distributed in the peripheral direction and run approximately in the direction of the rotation axis (A) and/or mutually separated compartments (13), a first feeding device (40) for supplying printed products (P) to the Processing drum (10), an evacuation conveyor (90, 91), disposed downstream in relation to a first feed (40) in the direction of the rotation axis (A) in the direction of the axial component (F) or the direction of conveyance, for transporting the print articles (E) away from the processing drum (10), conveying elements, assigned to the compartments (13) and/or rests (21), for transporting the printed products in the direction (F) in the course of the revolutions of the processing drum (10), and a working device and/or at least one further feeding device or feed station (41, 42, 43, 44), disposed between the first feeding device (40) and the evacuation conveyor (90, 91), for working the printed products (P, T) and for supplying further printed products (P2, P3, P4), wherein between the first feeding device (40) and the evacuation conveyor (90, 91) there is arranged at least one secondary conveying section (50, 60, 70), wherein the secondary conveying section (50, 60, 70) comprises an outfeed conveyor (51, 61, 71), a secondary conveyor (52, 62, 72), and a return mechanism (53, 63, 73), wherein the outfeed conveyor (51, 61, 71) feeds out from the collecting drum (10) the products (T3) to be conveyed outward, the products (T3) are conveyed in the secondary conveyor (52, 62, 72) from the outfeed conveyor (51, 61, 71) to the return mechanism (53, 63, 73), and are lead by the return mechanism (53, 63, 73) back into the drum (10), wherein between the outfeed conveyor (51, 61, 71) and the return mechanism (53, 63, 73) there is arranged at least one further Feeding unit (44), and wherein the outfeed conveyor (51, 71) feeds out on a lower strand of the collecting drum (10) the products (T3) to be conveyed outward, and the products are led by the return mechanism (53, 73), on an upper strand, back into the drum (10).

9. The device (1) of claim 8, wherein the products (T3) between the outfeed conveyer (51, 71) and the return mechanism (53, 73) are pivoted at least through a 180° are in relation to the drum axis (A).

10. The device (1) of claim 8, wherein the products (T3) are conveyed out of the drum with a supporting edge oriented traversely to the principal path of conveyance (F).

11. The device (1) of claim 8, wherein the secondary conveying section (50, 60, 70) comprises a clamping conveyor.

12. The device (1) of claim 8, wherein the collecting drum (10) is a collecting drum in the narrower sense, preferably a gathering-stitching drum or an insertion drum.

13. The device (1) of claim 8, wherein along the secondary conveying section there are arranged further devices for the supplying of products and/or for the working of the conveyed products.

14. A device (1) for processing printed products, comprising:

a collecting drum (10) driven rotatingly about an approximately horizontal rotation axis (A) and divided at least functionally into axial portions, the collecting drum including saddle-shaped rests (20), which are open to the outside in the radial direction, are evenly distributed in the peripheral direction and run approximately in the direction of the rotation axis (A), and/or mutually separated compartments (13), a first feeding device (40) for supplying printed products (P) to the processing drum (10), an evacuation conveyor (90, 91), disposed downstream in relation to a first feed (40) in the direction of the rotation axis (A) in the direction of the axial component (F) of the direction of conveyance, for transporting the print articles (E) away from the processing drum (10), conveying elements, assigned to the compartments (13) and/or rests (21), for transporting the printed products in the direction (F) in the course of the revolutions of the processing drum (10), and a working device and/or at least one further feeding device or feed station (41, 42, 43, 44), disposed between the first feeding device (40) and the evacuation conveyor (90, 91), for working the printed products (P, T) and for supplying further printed products (P2, P3, P4), wherein between the first feeding device (40) and the evacuation conveyor (90, 91) there is arranged at least one secondary conveying section (50, 60, 70), wherein the secondary conveying section (50, 60, 70) comprises an outfeed conveyor (51, 61, 71), a secondary conveyor (52, 62, 72), and a return mechanism (53, 63, 73), wherein the outfeed conveyor (51, 61, 71) feeds out from the collecting drum (10) the products (T3) to e conveyed outward, the products (T3) are conveyed in the secondary conveyor (52, 62, 72) from the outfeed conveyor (51, 61, 71) to the return mechanism (53, 63, 73), and are led by the return mechanism (53, 63, 73) back into the drum (10), wherein between the outfeed conveyor (51, 61, 71) and the return mechanism (53, 63, 73) there is arranged at least one further feeding unit (44), and wherein the outfeed conveyor (61) feeds out on an upper strand of the collecting drum (10) the products (T3) to he conveyed outward, and the products are led by the return mechanism (63), on an upper strand, back into the drum (10).

15. The device (1) of claim 14, wherein the products (T3) between the outfeed conveyor (51, 71) and the return mechanism (53, 73) are pivoted at least through a full 360° are in relation to the drum axis (A).

16. The device (1) of claim 14, wherein the products (T3) are conveyed, out of the drum with a supporting edge orientated transversely to the principal path of conveyance (F).

17. The device (1) of claim 14, wherein the secondary conveying section (50, 60, 70) comprises a clamping conveyor.

18. The device (1) of claim 14, wherein the collecting drum (10) is a collecting drum in the narrower sense, preferably a gathering-stitching drum or an insertion drum.

19. The device (1) of claim 14, wherein along the secondary conveying section there are arranged further devices for the supplying of products and/or for the working of the conveyed products.

* * * * *